US009004963B1

(12) United States Patent
Wulff

(10) Patent No.: US 9,004,963 B1
(45) Date of Patent: Apr. 14, 2015

(54) MARINE PROPULSION UNIT AND APPARATUS FOR COLLECTING LINE THEREON

(71) Applicant: Thomas Wulff, Kuttawa, KY (US)

(72) Inventor: Thomas Wulff, Kuttawa, KY (US)

( * ) Notice: Subject to any disclaimer, the term of this patent is extended or adjusted under 35 U.S.C. 154(b) by 32 days.

(21) Appl. No.: 13/671,960

(22) Filed: Nov. 8, 2012

Related U.S. Application Data

(60) Provisional application No. 61/557,128, filed on Nov. 8, 2011.

(51) Int. Cl.
*B63H 1/28* (2006.01)
*B63H 5/16* (2006.01)

(52) U.S. Cl.
CPC ..... *B63H 5/165* (2013.01)

(58) Field of Classification Search
CPC ..... B65H 5/165
USPC ..... 440/50, 51, 66, 76, 78, 79, 80, 83, 73, 440/49; 416/247 A, 247 R
See application file for complete search history.

(56) References Cited

U.S. PATENT DOCUMENTS

| | | | | | |
|---|---|---|---|---|---|
| 4,236,872 | A | * | 12/1980 | Metcalf | 416/146 R |
| 4,609,361 | A | * | 9/1986 | Sumino et al. | 440/73 |
| 4,891,026 | A | | 1/1990 | Haman et al. | |
| 4,911,663 | A | | 3/1990 | Meier | |
| 4,946,410 | A | * | 8/1990 | Haman | 440/83 |
| 5,522,703 | A | * | 6/1996 | Okamoto | 416/93 A |
| 5,547,408 | A | | 8/1996 | Skyman | |
| 5,766,047 | A | * | 6/1998 | Alexander et al. | 440/81 |

* cited by examiner

*Primary Examiner* — Lars A Olson
*Assistant Examiner* — Anthony Wiest
(74) *Attorney, Agent, or Firm* — McGarry Bair PC

(57) ABSTRACT

A line collector for a marine propulsion unit comprises a spool-like body for collecting fishing line, nets, weeds, and other debris. The line collector can be positioned between two propellers to protect an internal seal of the marine propulsion unit.

6 Claims, 7 Drawing Sheets

MARINE PROPULSION UNIT AND APPARATUS FOR COLLECTING LINE THEREON

CROSS-REFERENCE TO RELATED APPLICATION

This application claims the benefit of U.S. Provisional Patent Application No. 61/557,128, filed Nov. 8, 2011, which is incorporated herein by reference in its entirety.

BACKGROUND OF THE INVENTION

In marine propulsion units having a gear case below the water line and at least one propeller mounted on a propeller shaft, at least one first seal is normally applied on the propeller shaft for preventing water from entering the drive housing and at least one second seal is normally applied on the propeller shaft for preventing transmission lubricants or oil from leaking out into the water.

Fishing lines, nets, weeds, and other debris can catch on the propeller, and can wind around the propeller shaft as it rotates. The fishing line, etc. can work into the housing of the propulsion unit and can damage the seals, thereby resulting in leakage of water into the housing and/or leakage of lubricants or oil out of the housing.

A common solution proposed for the entanglement issue in single propeller marine propulsion units is the provision of a line cutter, which is typically placed near the strut and operates by cutting fishing lines and debris away from the propeller shaft. However, such line cutters are high maintenance because placement near the strut makes installation and servicing difficult, in addition to exposing a potentially dangerous sharp cutting edge. Furthermore, line cutters do not exist for single or dual propeller systems with a gear case below the water line, which form a significant proportion of all marine propulsion units.

BRIEF DESCRIPTION OF THE INVENTION

A marine propulsion unit according to one aspect of the invention comprises a first propeller coupled with a first propeller shaft, a second propeller coupled with a second propeller shaft, wherein the first and second propeller shafts are concentric, at least one seal between the first and second propeller shafts, and a line collector positioned between the first and second propellers for collecting line caught by the propellers, and directing the line away from the at least one seal.

In accordance with another aspect of the invention, an apparatus for collecting line caught by a propeller on a marine propulsion unit comprises a first section having a first central bore configured to receive a propeller shaft coupled with the propeller, and a second section joined to the first section and having a second central bore configured to receive the propeller shaft, wherein the first section has an outer annular surface with a first outer diameter and the second section has an outer annular surface with a second outer diameter that is less than the first outer diameter at the junction of the first and second sections, and whereby line caught by the propeller can be collected on the second section substantially at the second outer diameter.

DETAILED DESCRIPTION

The present invention relates generally to protecting the seal(s) of a propulsion unit of a marine drive. For purposes of description related to the figures, it is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
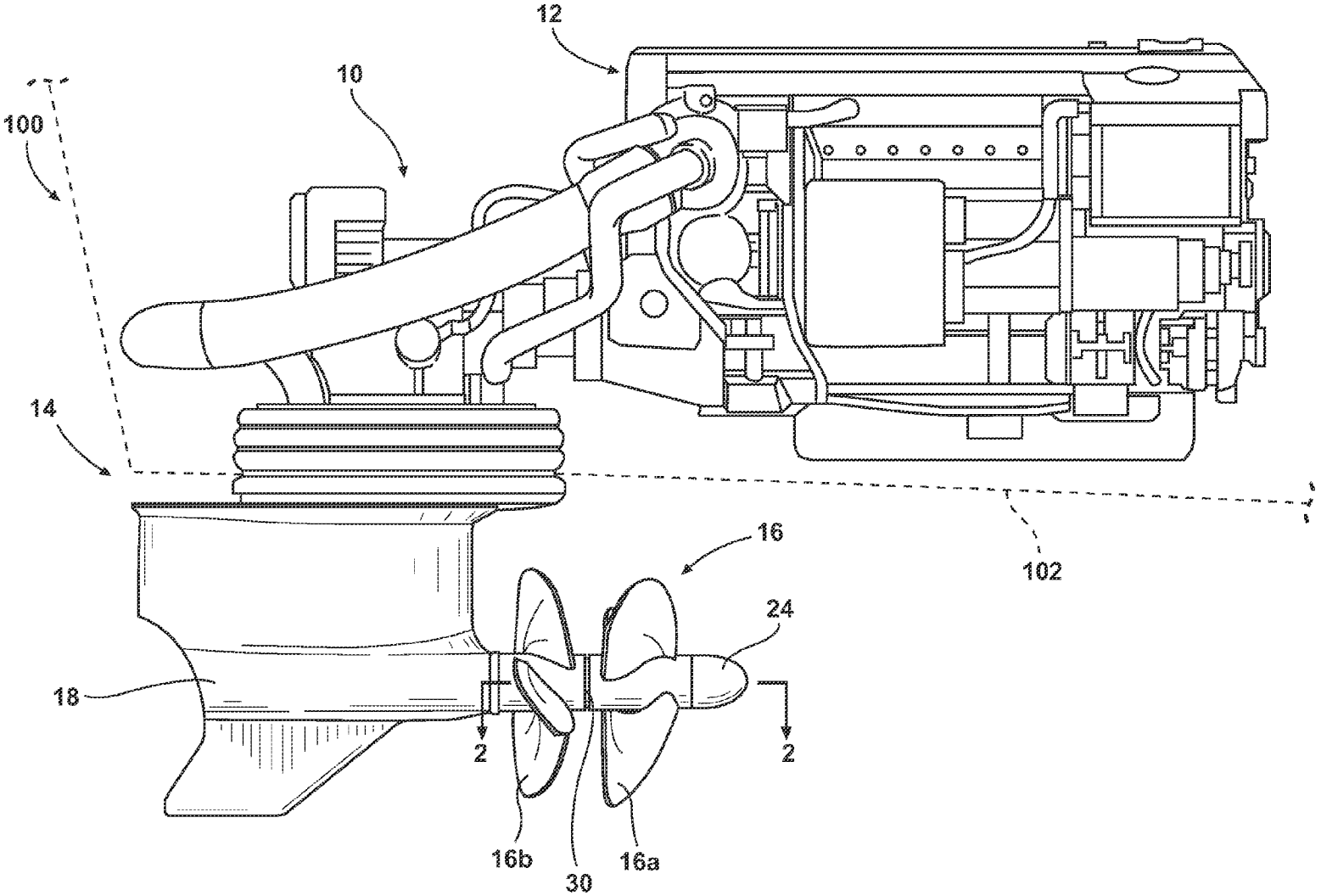
FIG. 1 is a side view of a marine drive comprising a line collector according to a first embodiment of the invention.

FIG. 1 is a side view of a marine drive 10 according to a first embodiment of the invention. The marine drive 10 can be provided on a boat 100 and comprises an engine 12 operably connected with a propulsion unit 14. The propulsion unit 14 is illustrated as having a dual propeller system 16 which includes two counter-rotating propellers, a fore propeller 16*a* and an aft propeller 16*b*. One example of a suitable marine drive 10 is the Volvo Penta Inboard Performance System (IPS), in which the propellers 16*a*, 16*b* are forward-facing, thereby facing in direction of travel of the boat 100. The marine drive 10 can be used singly on the boat 100 or in combination with one or more additional marine drives 10 provided the boat 100, such as in a twin mounting arrangement in which two marine drives 10 are mounted next to one another. The marine drive 10 can have a gear case or housing 18 below the water line of the boat 100, which may be defined by a bottom 102 of the boat 100, although it is understood that the actual water line may be above the bottom 102 of the boat 100 when in use. Therefore, the housing 18 may be above the bottom 102 of some boats 100, but still be below the water line.

Figure 2:
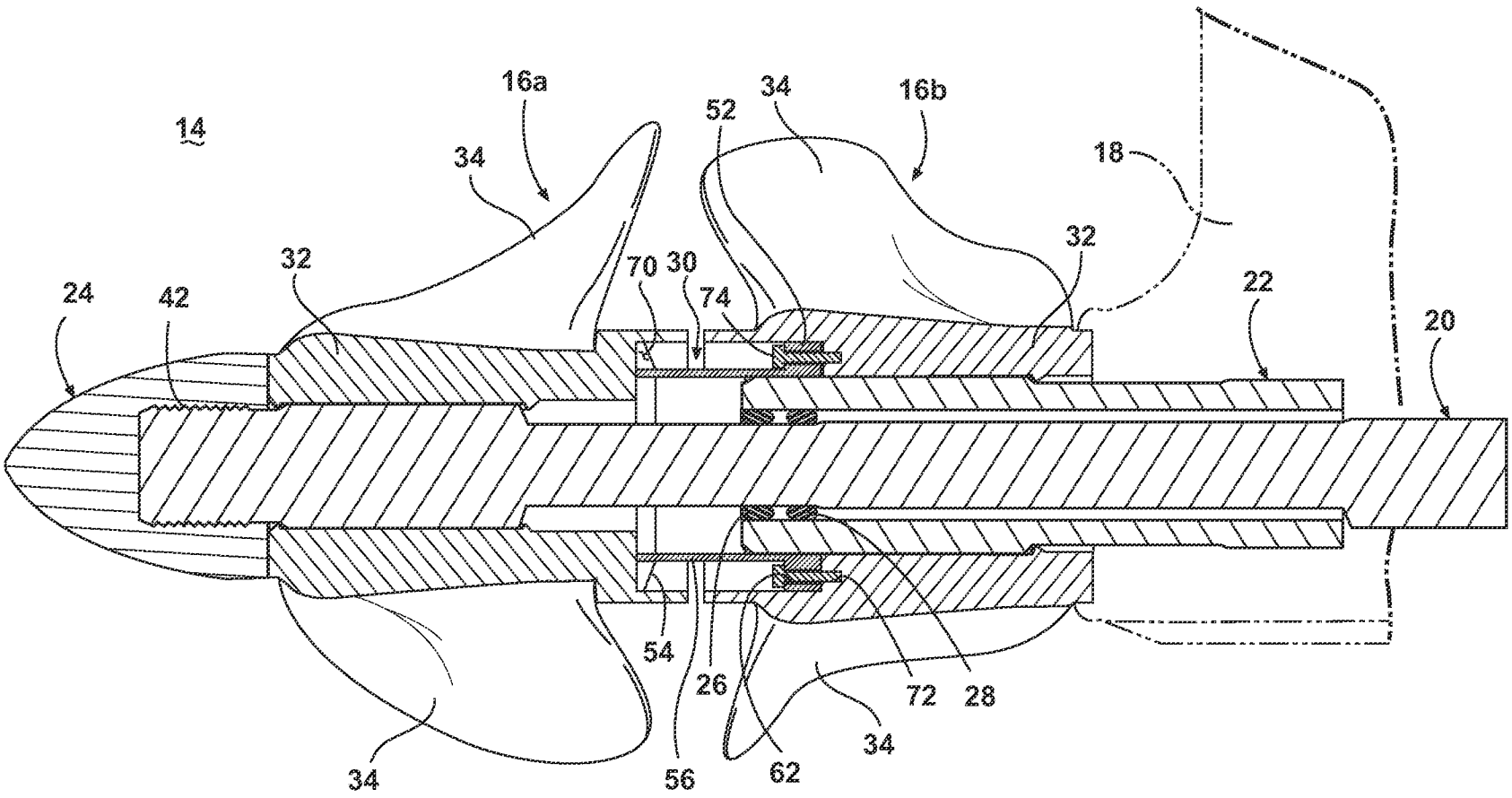
FIG. 2 is a cross-sectional view though line 2-2 of FIG. 1.

FIG. 2 is a cross-sectional view though line 2-2 of FIG. 1. The propulsion unit 14 further comprises the gear case or housing 18 and a pair of concentric propeller shafts which extend from the housing 18, an inner propeller shaft 20 which drives the fore propeller 16*a* and a hollow outer propeller shaft 22 through which the inner propeller shaft 20 extends and which drives the aft propeller 16*b*. The engine 12 (FIG. 1) drives the rotation of the shafts 20, 22 in opposite directions via a conventional transmission (not shown) at least partially contained within the housing 18. A spinner cone 24 can be mounted forwardly or upstream of the fore propeller 16*a*.

A first water seal 26 is provided between the inner propeller shaft 20 and the outer propeller shaft 22, and faces forwardly for preventing water from entering the propulsion unit 14. A second oil seal 28 is provided on the inner propeller shaft 20 and the outer propeller shaft 22, and faces rearwardly for preventing transmission lubricants or oil from leaking out into the water from the housing 18.

A line collector 30 is mounted between the propellers 16*a*, 16*b* for collecting debris which may be caught by the propellers 16*a*, 16*b* and for directing it away from one or both of the seals 26, 28, as explained in detail below. As used herein, the term "line" or variations thereof refers to debris in a marine environment that may be caught by the propellers 16*a*, 16, including but not limited to fishing line, nets, strands, weeds, and the like.

Figure 3:
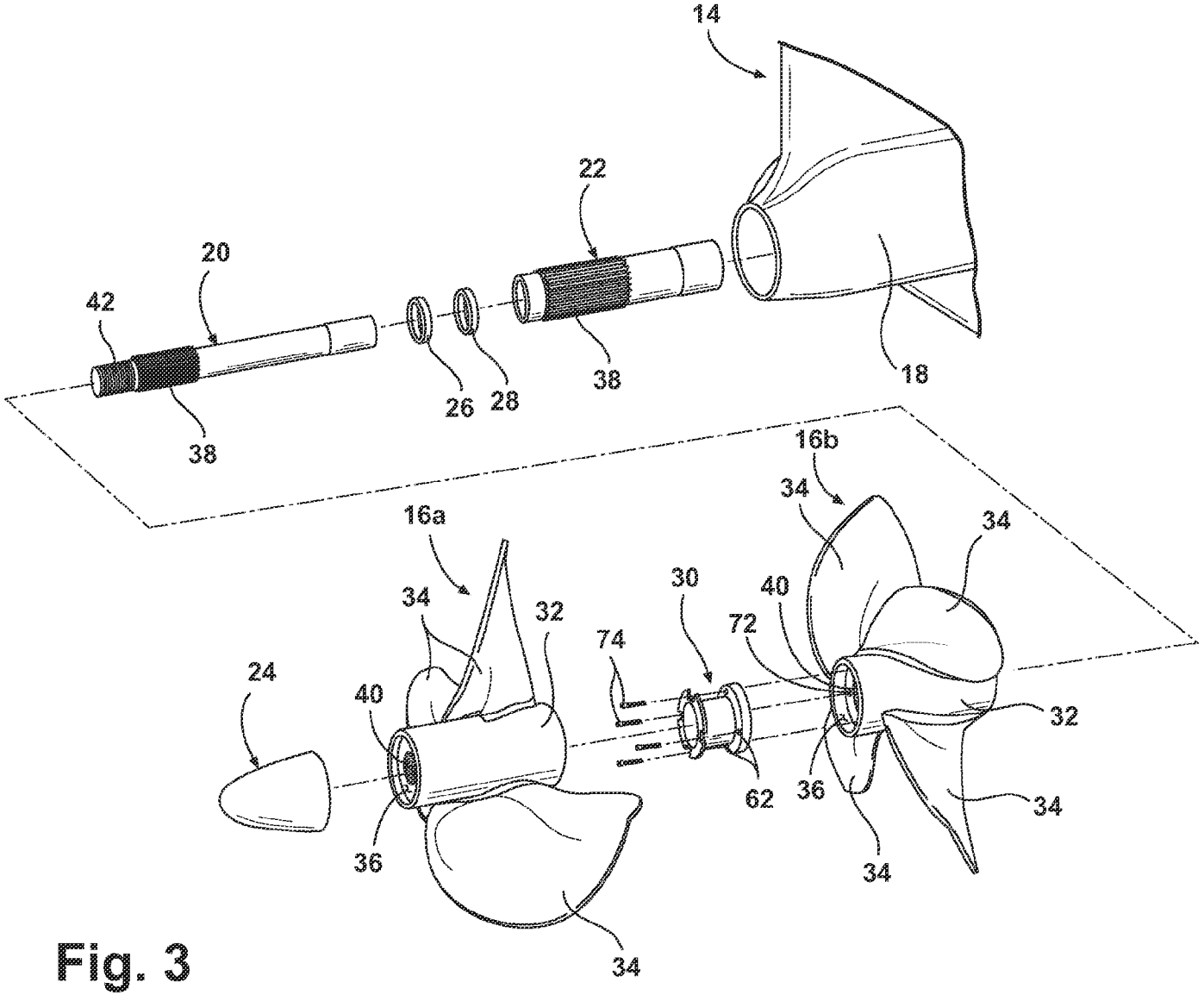
FIG. 3 is a partially exploded view of a portion of a propulsion unit of the marine drive from FIG. 1.

FIG. 3 is a partially exploded view of a portion of the propulsion unit 14 of the marine drive 10 of FIG. 1. The propellers 16*a*, 16*b* each comprise a hub 32 with a plurality of blades 34 extending therefrom. Each hub 32 includes a central cavity 36. As illustrated, the fore propeller 16*a* comprises three blades 34 and the aft propeller 16*b* comprises four blades 34, although other blade configurations are possible.

The propeller shafts 20, 22 can be provided with a structure for retaining the dual propeller system 16 thereon in a fixed angular relationship such that the propellers 16*a*, 16*b* cannot rotate relative to the shaft 20, 22 during normal operation of the propulsion unit 14. As shown, the retaining structure can include a set of external splines 38 formed on the shafts 20, 22 which are received by a cooperating set of internal splines 40 formed in the hubs 32 of the propellers 16*a*, 16*b*.

The inner propeller shaft 20 can further be provided with a structure for retaining the spinner cone 24 thereon in a fixed angular relationship such that the spinner cone 24 cannot rotate relative to the shaft 20 during normal operation of the propulsion unit 14. As shown, the retaining structure can include set of external threads 42 formed on the shaft 20, forwardly of the splines 38, which are received by a cooperating set of threads (not shown) formed in the spinner cone 24.

Figure 4:
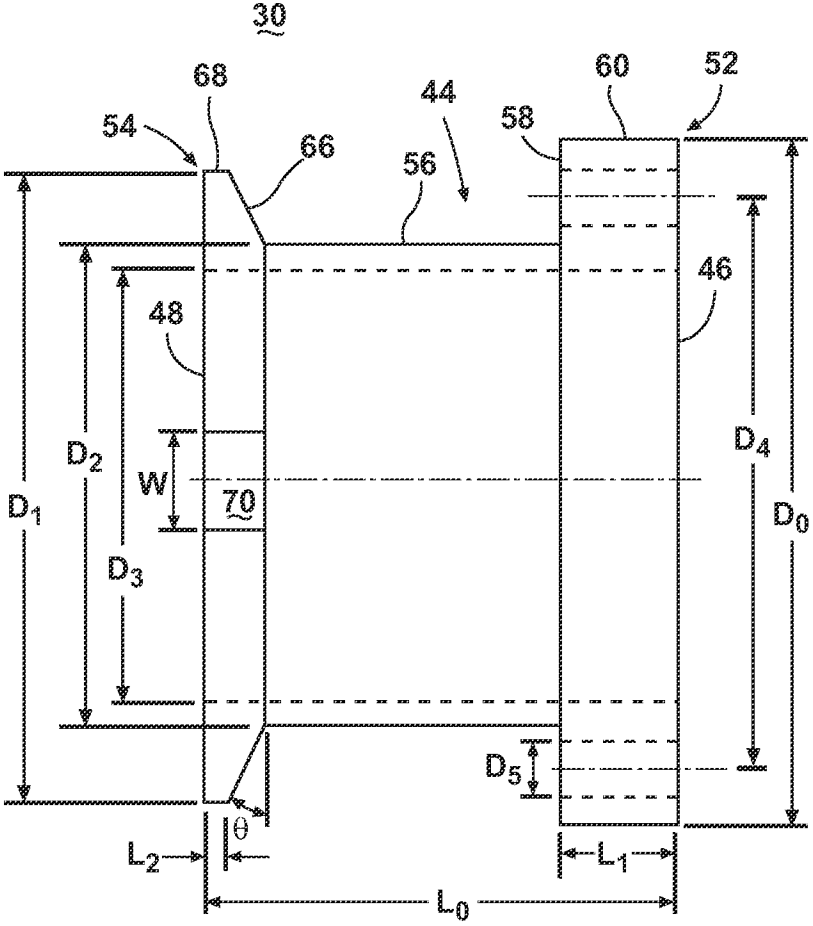
FIG. 4 is a side view of the line collector from FIG. 1.

FIG. 4 is a plan view of the line collector 30 of FIG. 1. The line collector has a collecting section on which line is collected, and a directing section which directs line toward the collecting section. The line collector 30 illustrated herein has a spool-like or spool-shaped body 44 having a first end face 46, a second end face 48, and a central bore 50 extending through the body 44 from the first end face 46 to the second end face 48. The body 44 includes a first flange 52 defining the first end face 46 and a second flange 54 spaced from the first flange 52 and defining the second end face 48. The second flange 54 can have a reduced outer diameter D1 in comparison to the outer diameter D0 of the first flange 52. A barrel 56 between the flanges 52, 54 is formed by a further reduced outer diameter portion D2 of the body 44. The body 44 can be formed as a single component as by machining, milling, casting, molding, or the like; alternatively, one or more of the flanges 52, 54 and the barrel 56 can be manufactured separately, and assembled together, such as by welding the pieces together, for example.

The first flange 52 has a first inner face 58 opposite the first end face 46 and connected thereto by an outer annular surface or rim 60. The inner and end faces 58, 46 can be substantially parallel to each other as shown herein. The first flange 52 has one or more openings 62 extending through the inner and end faces 58, 46 for assembling the line collector 30 with the aft propeller 16*b*, as described below. As shown herein, four equally-spaced openings 62 can be provided.

The second flange 54 has a second inner face 66 opposite the second end face 48 and connected thereto by an outer annular surface or rim 68. The inner and end faces 66, 48 can be oriented at an angle to one another, which facilitates line collection, as described below. As shown herein, the inner face 66 can be canted in an outward direction from the outer annular surface of the barrel 56 in an aft direction, at an angle θ from vertical, such that the diameter of the inner face 66 tapers toward the barrel 56. One or more cut-outs 70 on the second flange 54 provide a pass through for tools used during installation of the line collector 30 on the aft propeller 16*b*, as described below.

The dimensions for the line collector 30 can vary depending on the application of the line collector 30, and the dimensions of the propulsion unit 14 on which the line collector 30 is installed. One non-limiting example of a set of dimensions for the line collector 30 are: an outer diameter of the first flange 52, D0=3.726 inches (9.464 cm); an outer diameter of the second flange 54, D1=3.460 inches (8.788 cm); and outer diameter of the barrel 56, D2=2.615 inches (6.642 cm); an inner diameter of the central bore, D3=2.415 inches (6.134 cm); a distance between centers of opposing openings 62, D4=3.156 inches (8.016 cm); a diameter of openings 62, D5=0.326 inches (0.828 cm); a length of body 44, L0=2.592 inches (6.584 cm), a length of outer rim 60, L1=0.592 inches (1.504 cm); a length of outer rim 68, L2=0.125 inches (0.318 cm); a width of cut-outs 70, W=0.5625 inches (1.429 cm); and an angle of the inner face 66 from vertical, θ=30.°

Suitable materials for the line collector 30 can also vary depending on the application of the line collector 30, such as upon the marine environment in which the line collector 30 will be used. Some examples of materials that may be suitable for the line collector 30 are stainless steel, bronze, nickel-aluminum-bronze alloys, other materials that are corrosion resistant.

Referring back to FIGS. 2 and 3, the aft propeller 16*b* can further be provided with a structure for retaining the line collector 30 in a fixed angular relationship with the aft propeller 16*b*, such that the line collector 30 cannot rotate relative to the aft propeller 16*b* during normal operation of the propulsion unit 14, while permitting the line collector 30 to rotate relative to the counter-rotating fore propeller 16*a*. As shown, the retaining structure can include the set of openings 62 in the first flange 52 and a corresponding set of openings 72 in the hub 32 of the aft propeller 16*b*, which can receive fasteners 74 to couple the line collector 30 to the aft propeller 16*b*. The fasteners 74 and the openings 72 can be threaded to maintain a tight connection. The cut-outs 70 are aligned with the openings 62, such that a tool can be used during installation of the line collector 30 on the aft propeller 16*b* to install and/or tighten the fasteners 72.

While the primary function of the cut-outs 70 is to facilitate installation of the line collector 30, in some, but not all, instances, the cut-outs 70 can provide a secondary function of cutting or severing fishing line, nets, weeds, and other debris encountered by the line collector 30. However, the overall purpose of the line collector 30 is to direct fishing line, nets, weeds, and other debris away from the internal seal(s), and not to cut debris. Alternatively, a line cutter as known in the art can be provided on the line collector 30 to enhance the cutting capabilities of the line collector 30.

The line collector 30 is at least partially exterior to the propellers 16*a*, 16*b*, such that at least a portion of the line collector 30 is exposed to the marine environment during operation. As illustrated, the barrel 56 of the line collector 30 can be exposed to the marine environment during operation, with a portion of the line collector 30 received within the central cavities 36 of the hubs 32. Specifically, at least a portion of the central cavity 36 of the aft propeller 16*b* can be sized to receive the first flange 52. Likewise, at least a portion of the central cavity 36 of the fore propeller 16*a* can be sized to receive the second flange 54. Since the fore propeller 16*a* rotates relative to the line collector 30, a clearance can be provided between the second flange 54 and the hub 32 of the fore propeller 16*a*.

As noted above, the line collector 30 functions to direct line away from one or both of the seals 26, 28 and collect the line so that the line cannot damage the seals 26, 28. The second flange 54 with the tapered or angled inner face 66 defines the directing section of the line collector 30 since the inner face 66 directs line toward the barrel 56, and the barrel 56 defines the collection section of the line collector 30, since line is collected on the barrel 56.

In operation, the line collector 30 can function to prevent failure of one or more of the seal(s) 26, 28 shown in FIG. 2. Without the line collector 30, fishing line, nets, weeds, and other debris can work under the aft propeller 16*b*, and can cause failure of the water seal 26, and in some cases the oil seal 28. If the water seal 26 fails, water can enter the propulsion unit 14, potentially causing failure of the marine drive 10. If the oil seal 28 fails, transmission lubricants or oil can leak out from the housing 18. The line collector 30 prevents fishing line, nets, weeds, and other debris from getting to the seals 26, 28 and collects such debris on the barrel 56 before it can do damage. Features of the line collector 30 such as its spool-shaped body 44 and the angled inner face 66 help to direct debris toward the barrel 56. While line and debris collection and guidance away from the seals 26, 28 are the primary benefit provided by the line collector 30, one side effect of the rotation of the line collector 30 caused by its coupling to the aft propeller 16*b* is possible cutting or severing of lines and debris, which can also help protect the seals 26, 28. However, while the line collection feature is dependable with the line collector 30, line cutting is irregular and not as dependable.

While the line collector 30 is shown and described with respect to a marine propulsion unit 14 having a forward-facing dual propeller system 16 in FIGS. 1-3, it is understood that that the line collector 30 can be used with other types of marine propulsion units, including a rearward-facing dual propeller system and a single propeller system. Furthermore, while the marine drive 10 is illustrated as comprising an inboard drive, the line collector 30 can also be used in conjunction with outdrives, stern drives, and pod drives. Two examples of alternate marine propulsion units are shown in FIGS. 6-7.

Figure 6:
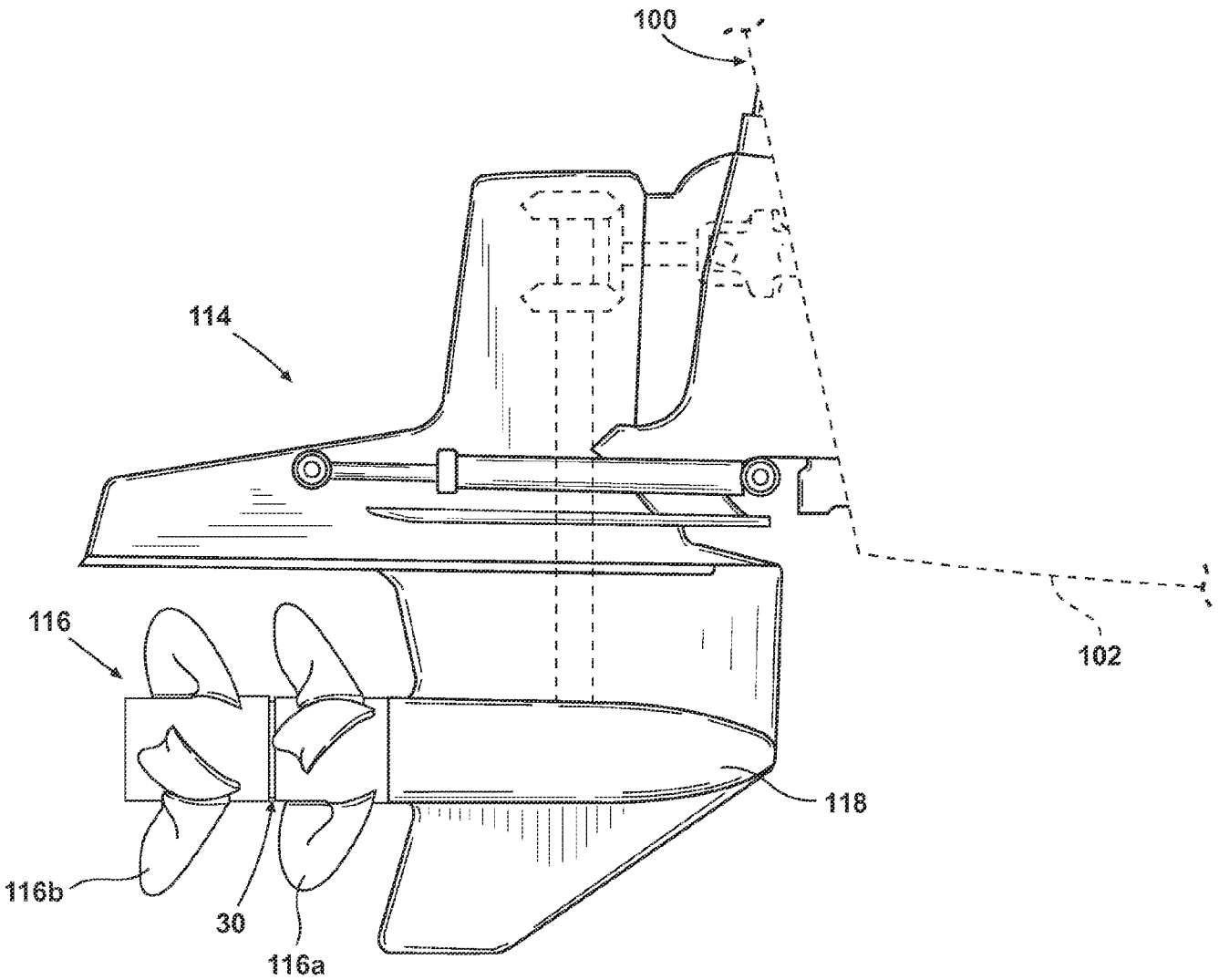
FIG. 6 is a side view of a marine propulsion unit comprising a line collector according to a second embodiment of the invention.

FIG. 6 is a side view of a marine propulsion unit 114 comprising a line collector 30 according to a second embodiment of the invention, the marine propulsion unit 114 being mounted to the transom of boat 100. The marine propulsion unit 114 can have a similar structure as described above for the first embodiment, with one exception being that it comprises a rearward-facing dual propeller system 116 having fore and aft propellers 116*a*, 116*b* extending from a gear case or housing 118. The housing 118 can be located below the water line of the boat 100.

The line collector 30 can be positioned between the propellers 116*a*, 116, in much the same manner as disclosed above for the first embodiment. In this embodiment, the first flange 52 (FIG. 4) of the line collector 30 can be attached to the fore propeller 116*a*. The internal seals, while not shown, can be provided between shafts for the propellers 116*a*, 116*b* as described above. The line collector 30 can function to protect the internal seals from damage caused by fishing line, nets, weeds, and other debris.

Figure 7:
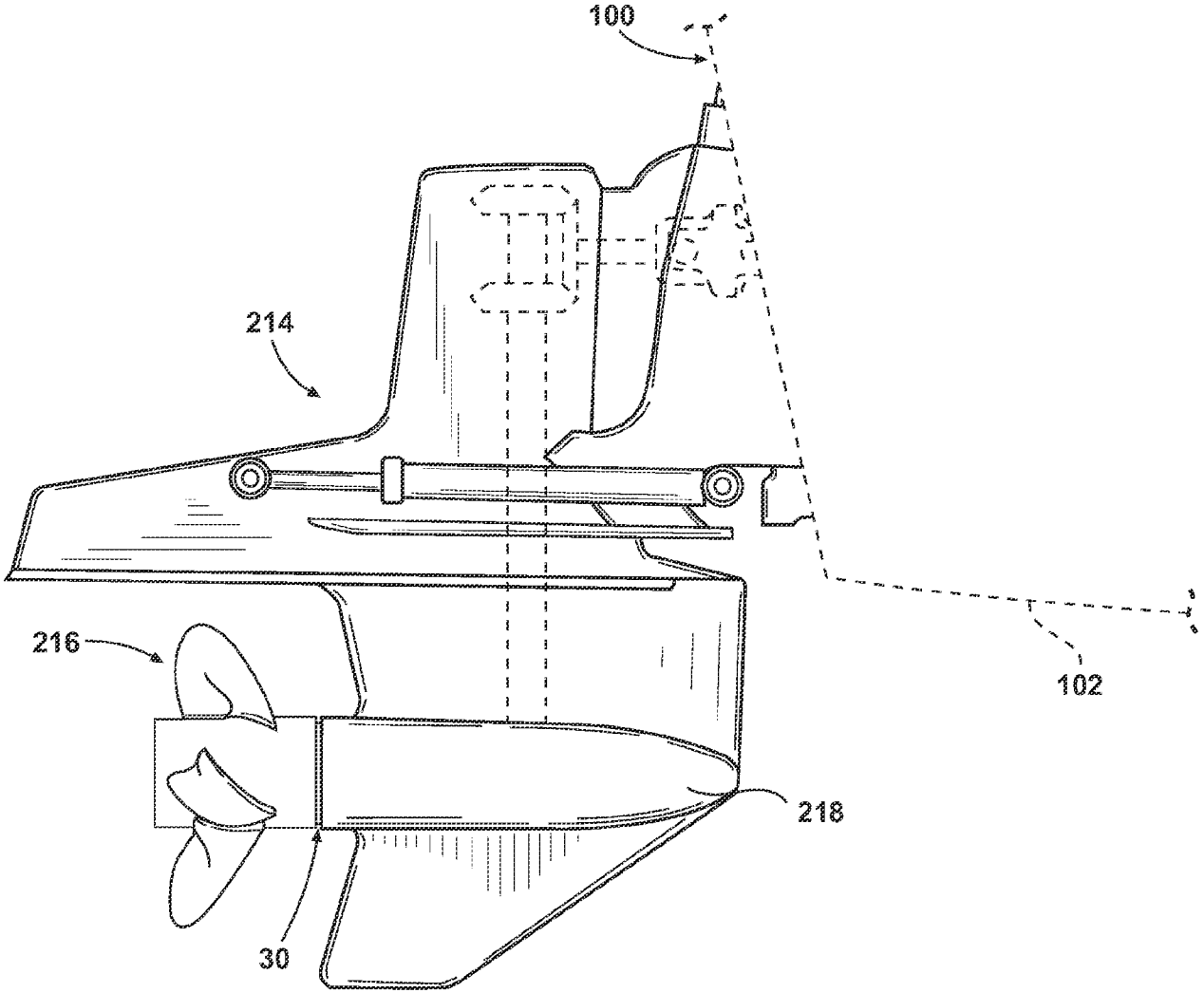
FIG. 7 is a side view of a marine propulsion unit comprising a line collector according to a third embodiment of the invention.

FIG. 7 is a side view of a marine propulsion unit 214 comprising a line collector 30 according to a third embodiment of the invention, the marine propulsion unit 214 being mounted to the transom of a boat 100. The marine propulsion unit 214 comprises a single propeller system having a single propeller 216 extending from a gear case or housing 218. The housing 218 can be located below the water line of the boat 100.

The line collector 30 can be positioned between the propeller 216 and the housing 218 in much the same manner as disclosed above for the first embodiment. In this embodiment, the first flange 52 (FIG. 4) of the line collector 30 can be attached to the housing 218. In this case, the line collector 30 can function to protect a strut bearing within the housing 218 from damage caused by fishing line, nets, weeds, and other debris.

Figure 5:
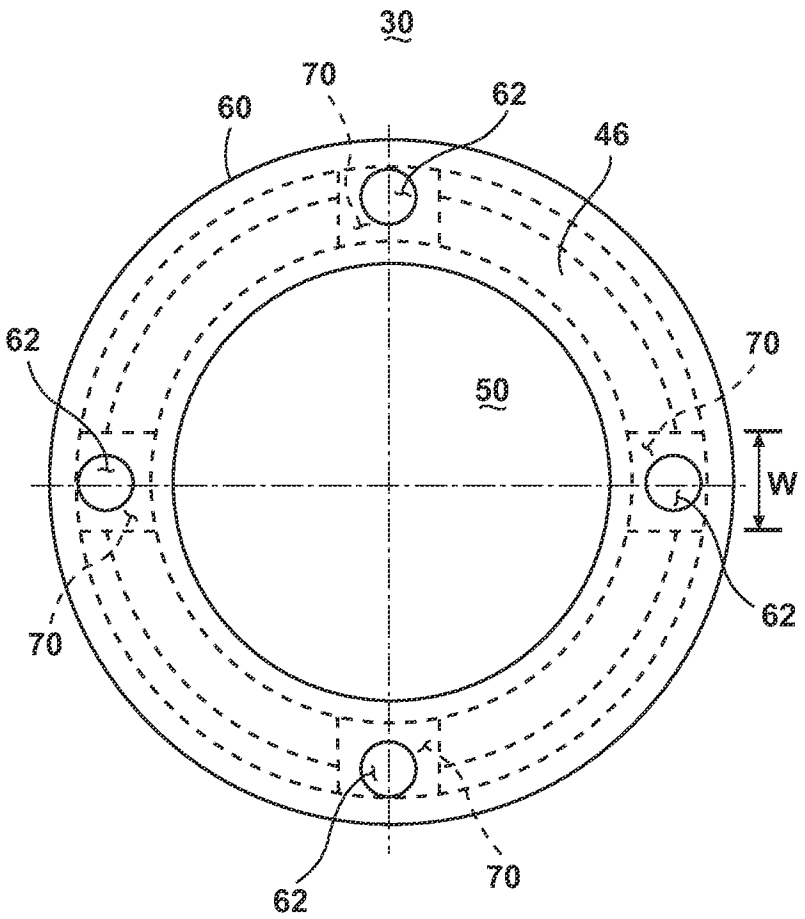
FIG. 5 is a plan view of the line collector from FIG. 1.
Figure 8:
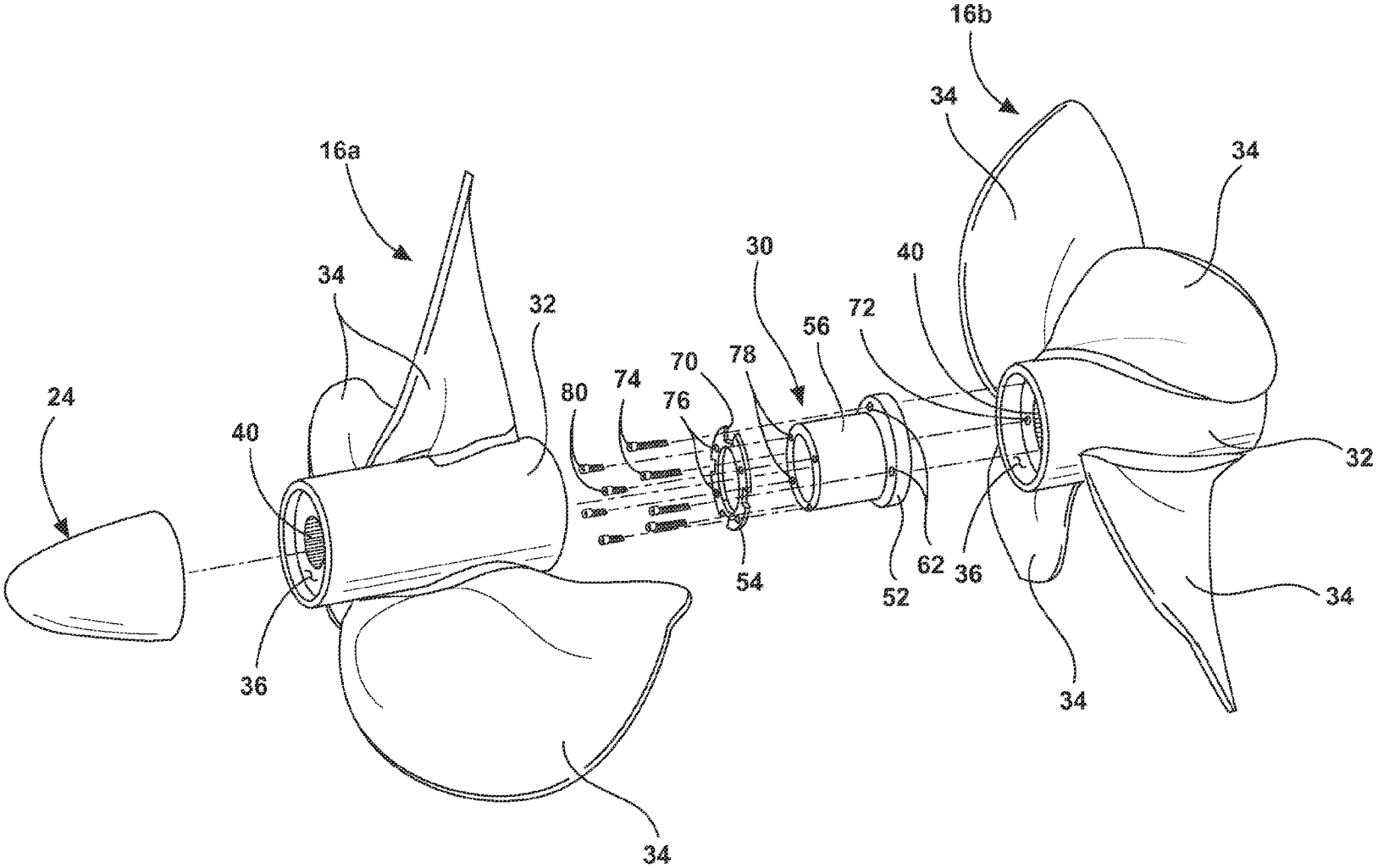
FIG. 8 is a partially exploded view of a portion of a propulsion unit according to a fourth embodiment of the invention.

FIG. 8 is a partially exploded view of a portion of a propulsion unit 14 according to a fourth embodiment of the invention. The propulsion unit 14 is substantially similar to the propulsion unit 14 shown in FIG. 3, and can be used with the marine drive 10 shown in FIG. 1, with the exception of the line collector 30. In the fourth embodiment, the line collector 30 is substantially identical to the line collector 30 shown in FIGS. 4-5, except that the spool-shaped body 44 of the line collector 30 can be formed in multiple sections, rather than the one piece body 44 shown in FIGS. 4-5. In particular, the second flange 54 can be a separate section from the first flange 52 and the barrel 56. The second flange 54 attached to the barrel 56 using a welding technique, or using at least one mechanical fastener. As shown herein, the second flange 54 has one or more openings 76 extending there through for assembling the second flange 54 with the barrel 56. As shown herein, four equally-spaced openings 76 can be provided between the cut-outs 70. A corresponding set of openings 78 can be provided in the barrel 56, which can receive fasteners 80 to couple the second flange 54 to the barrel 56. The fasteners 80 and the openings 78 can be threaded to maintain a tight connection. Alternatively, the openings 76, 78 in the second flange 54 and barrel 56 can be aligned with the openings 62, 72 in the first flange 52 and the hub 32 such that only the first fasteners 74 are need to couple the line collector 30 together and to the hub 32.

While the line collector 30 is shown in FIG. 8 as being formed in two separate sections, it is also contemplated that the line collector 30 can be formed in three sections, with the first flange 52, second flange 54, and barrel 56 all comprising separate sections that are joined together as described above. In still another variation, the first flange 52 can be formed as a separate section from the second flange 54 and the barrel 56.

The line collector 30 disclosed herein provides several advantages to propulsion units and marine drives. One advantage that may be realized in the practice of some embodiments of the described device is that the line collector 30 may greatly reduce or stop seal failure caused by the entanglement of fishing line, nets, weeds, and other debris between the propellers of a marine propulsion unit having a gear case below the water line. The line collector 30 protects the seals from stress and caused by the entangled fishing line, etc., thereby reducing wear on the seal and preventing the premature failure of the propulsion unit. Another advantage that may be realized in the practice of some embodiments of the described device is that the line collector 30 is virtually maintenance free once installed, and the installation of the line collector 30 is facilitated by its configuration. Yet another advantage that may be realized in the practice of some embodiments of the described device is that the line collector 30 is easily adaptable to virtually any dual propeller propulsion unit, including outdrive or pod drive propulsion units, and further can also be adapted for use on single propeller propulsion units. Virtually any marine outdrive system with counter-rotating propellers can benefit from the line collector 30 if it has internal seals.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A marine propulsion unit comprising:

a first propeller coupled with a first propeller shaft;

a second propeller coupled with a second propeller shaft, wherein the first and second propeller shafts are concentric;

at least one seal between the first and second propeller shafts;

a line collector positioned between the first and second propellers for collecting line caught by the propellers, and directing the line away from the at least one seal;

wherein the line collector comprises a directing section having a first outer diameter; and a collecting section joined to the directing section and having a second outer diameter that is less than the first outer diameter at a junction of the directing and collecting sections;

wherein the directing section tapers to the second outer diameter at the junction to direct line toward the collecting section; and wherein the line collector is positioned within the first and second propellers, with a space between the first and second propellers such that the collecting section can be exposed to the marine environment during operation of the marine propulsion unit.

2. The marine propulsion unit from claim 1, wherein the at least one seal comprises two seals between the first and second propeller shafts.

3. The marine propulsion unit from claim 2, wherein the two seals comprise a water seal and an oil seal.

4. The marine propulsion unit from claim 1, wherein the line collector is concentric with the first and second propeller shafts and radially overlies the at least one seal.

5. The marine propulsion unit from claim 1, wherein the line collector is mounted in a fixed angular relationship with the first propeller, such that the line collector does not rotate relative to the first propeller during operation of the marine propulsion unit.

6. The marine propulsion unit from claim 5, wherein the line collector comprises a central bore which receives the second propeller shaft in a spaced relationship, such that the line collector rotates relative to the second propeller during operation of the marine propulsion unit.

* * * * *